US005564236A

United States Patent [19]

McKinney et al.

[11] Patent Number: 5,564,236

[45] Date of Patent: Oct. 15, 1996

[54] DEADMAN

[75] Inventors: David McKinney; William Pratnicki, both of Holbrook, N.Y.

[73] Assignee: Rockmate, Inc., Uniondale, N.Y.

[21] Appl. No.: 376,848

[22] Filed: Jan. 23, 1995

[51] Int. Cl.[6] ..... E04G 21/04

[52] U.S. Cl. ..... 52/127.2; 52/DIG. 1

[58] Field of Search ..... 52/127.1, 127.2, 52/127.5, 127.6, 127.7, 166, 720.1, 720.3, 723.2, 724.1, 726.2, 729.5, 731.9, 731.7, 732.1, 733.2, 734.1, 734.2, 736.4, DIG. 1, 213, 749.1; 49/467

[56] References Cited

U.S. PATENT DOCUMENTS

| | | | |
|---|---|---|---|
| 920,941 | 5/1909 | Filkin . | |
| 2,889,632 | 6/1959 | Longhi . | |
| 3,047,165 | 7/1962 | Hutchinson . | |
| 4,164,346 | 9/1979 | Sickler . | |
| 4,283,892 | 8/1981 | Brown | 52/733.2 X |
| 4,709,527 | 12/1987 | Cooley | 52/127.2 X |
| 5,018,279 | 5/1991 | Williams . | |
| 5,224,309 | 7/1993 | Bodell . | |
| 5,371,994 | 12/1994 | Waters | 52/DIG. 1 X |

*Primary Examiner*—Creighton Smith

*Attorney, Agent, or Firm*—Curtis, Morris & Safford, P.C.; Thomas J. Kowalski

[57] ABSTRACT

Disclosed and claimed is a deadman for temporarily holding panel material in position while the material is being fastened to a supporting structure, such as in wall and ceiling construction and methods of use.

4 Claims, 3 Drawing Sheets

DEADMAN

FIELD OF THE INVENTION

This invention relates to wall and ceiling construction, and more particularly to a deadman for temporarily holding panel material in position while the material is being fastened to a supporting structure. Documents cited below incorporated herein by reference.

BACKGROUND OF THE INVENTION

Present practice in the building industry is to utilize large panels for both wall and ceiling construction. Panels are normally fabricated of laminations including plaster or plywood laminations. A typical panel is sheetrock. The normal size of a panel is four feet by eight feet. A panel of such size is quite difficult for one person to manage without assistance, especially when fastening the panel to ceiling supporting structure.

Systems such as deadmen and the like are used for assisting in fastening panels to supporting structure. These systems are particularly useful in situations where position, size, lack of manpower, or the like, make alignment and support of the panel difficult.

One apparatus for assisting in the fastening of ceiling panel is described in U.S. Pat. No. 3,047,165 issued Jul. 31, 1962 to Jack B. Hutchinson. This patent relates to a ceiling board jack consisting of an adjustable, collapsible three-legged frame for holding the panel flush to the ceiling while being fastened. Main drawbacks of this jack include that it is complex in construction (therefore expensive to build) and difficult to change positions for each panel. Also, the jack is not useful for fastening panels on wall supporting structure.

Another apparatus for assisting in the fastening of panels is discussed in U.S. Pat. No. 5,224,309 issued Jul. 6, 1993 to James R. Bodell. This patent relates to a cleat for supporting the panel during alignment and fastening. Although this cleat apparatus may be less cumbersome and more functional than previous systems, it has a three-piece construction, such that it is expensive to manufacture. The cleat apparatus also suffers from two further deficiencies. First, the cleat has a narrow structure such that if a single cleat were used, any torque on the panel would damage or break the panel. Secondly, the cleat lacks a means for easy removal after being fastened to the supporting structure.

Unfortunately, most prior art deadmen are generally unwieldy, hard to use, and expensive. Thus, there is a need for a cost-effective apparatus to assist the fastening of panels to a supporting structure in a simple and efficient manner which would require as little as one person to fasten the panels to the supporting structure.

OBJECTS OF THE INVENTION

An object of this invention is to provide an apparatus for assisting in the fastening of panels to supporting structure.

It is a further object of this invention to provide a cost-effective, light weight, efficient apparatus for assisting in the fastening of panels to supporting structure.

It is still a further object of this invention to provide an apparatus for assisting in the fastening of panels to supporting structure having means for easy attachment and detachment of the apparatus from a supporting structure.

The above and other objects, features and advantages of this invention will be apparent in the following detailed description of illustrative embodiments thereof.

SUMMARY OF THE INVENTION

This invention surprisingly provides a deadman for temporarily holding panel material in position while the material is being fastened to a supporting structure and methods of use.

More particularly in an embodiment, the invention provides an apparatus for temporarily holding panel material in position while the material is being fastened to a supporting structure, comprising a main body having a first pair of elongated, opposing, generally rectangular sides and a second pair of elongated, opposing, generally rectangular sides perpendicular and adjacent the first side pair; at least one pair of elongated, perpendicular, generally rectangular sides adjacent one of said first side pair and adjacent one of said second side pair defining a notch along the length of said main body; and means for securing the main body to the supporting structure.

In another embodiment, the invention provides a method for temporarily holding panel material in position while the material is being fastened to a supporting structure, comprising the steps of providing a deadman comprising a main body having a first pair of elongated, opposing, generally rectangular sides and a second pair of elongated, opposing, generally rectangular sides perpendicular and adjacent the first side pair, at least one pair of elongated, perpendicular, generally rectangular sides adjacent one of said first side pair and adjacent one of said second side pair defining a notch along the length of said main body, and means for securing the main body to the supporting structure; attaching the deadman to the supporting structure via the means for securing the main body to the supporting structure; inserting one edge of the panel material in the notch; placing the panel material flush to the supporting structure; and fastening the panel material to the supporting structure.

The deadman is preferably comprised of a long, single piece of substantially rigid material such a metal, plastic, and the like, having a substantially rectangular cross section. A notch is formed along the length of the deadman in at least one of the corners of the substantially rectangular cross section. The size of the notch determines the thickness of the panel which can be used with the deadman.

An important feature of the present invention is the means for attachment and detachment to the supporting structure. The means comprising of a plurality slots formed in any side of the deadman which will face the supporting structure. The slots are of a predetermined width to retain a head of a nail or screw, and are of a sufficient length to allow lateral adjustment of the deadman. It is understood that if the deadman is made of a solid material, the slots must be chamfered in such a manner to retain the head of the nail or screw. The spacing between slots are gauged to industry standards for spacing between stud members of a supporting structure. Preferably, slots are offset or arranged to accommodate a variety of standard spacings between stud members of a supporting structure. Additionally, each slot has an open area which is larger than the head of the nail or screw. Preferably, each open area is located proximate to the midpoint of the predetermined length of each slot.

Preferably the deadman is made from a rigid or semi-rigid light-weight material which can be hollowed and still maintain its rigidity. The rigidity is preferably sufficient to support a panel when the deadman is in use. Such materials include aluminum; steel; plastics and thermoplastics such as polyvinylchloride; polyacramide for instance KEVLAR™; high impact plastic for example, high impact polystyrene; wood; and the like. A hollowed deadman substantially reduces material costs and weight.

The deadman can be made from material which is extruded with the slots being formed during or after extrusion. The deadman can also be formed from molding, wherein the slots are formed in the molding process or are added after the molding is complete. Extrusion, blow molding, and extrusion blow molding are means of fabrication for the present invention.

A worker can single-handedly fasten panels to supporting structure by setting a plurality of screws or nails in the supporting structure at a predetermined location in a straight line which is perpendicular to the studs in the supporting structure. Each screw or nail is set such that a determined length of each screw or nail extends from the stud. The deadman is placed on the supporting structure with the selected notch toward the supporting structure such that the side with the slots is flush with the studs and the open areas receive the heads of the screws or nails. The deadman is then shifted laterally to secure the heads of the screws or nails in the slots.

Once the deadman is secured, the worker inserts one edge of the panel in the notch which will hold the panel edge in place while the worker fastens the opposing panel edge to the supporting structure. The worker then moves toward the deadman securing the panel to the supporting structure. Once the panel is fastened, the deadman is shifted laterally to align the open areas with the screw or nail heads and the deadman is then removed. Once the deadman is removed, the screws or nails are removed or preferably set into the stud members such that the heads are flush with the stud member surface. Thus when using the deadman, a worker can single-handedly fasten panels to the supporting structure.

BRIEF DESCRIPTION OF THE DRAWINGS

While the specification concludes with claims particularly pointing out and distinctly claiming that which is regarded as the present invention, the objects and advantages of this invention can be more readily ascertained from the following description of the invention when read in conjunction with the accompanying drawings in which:

DETAILED DESCRIPTION OF THE INVENTION

As discussed previously, this invention relates to wall and ceiling construction, and more particularly, provides a deadman for temporarily holding a panel material in position while the material is being fastened to a supporting structure and methods of use thereof.

Figure 1:
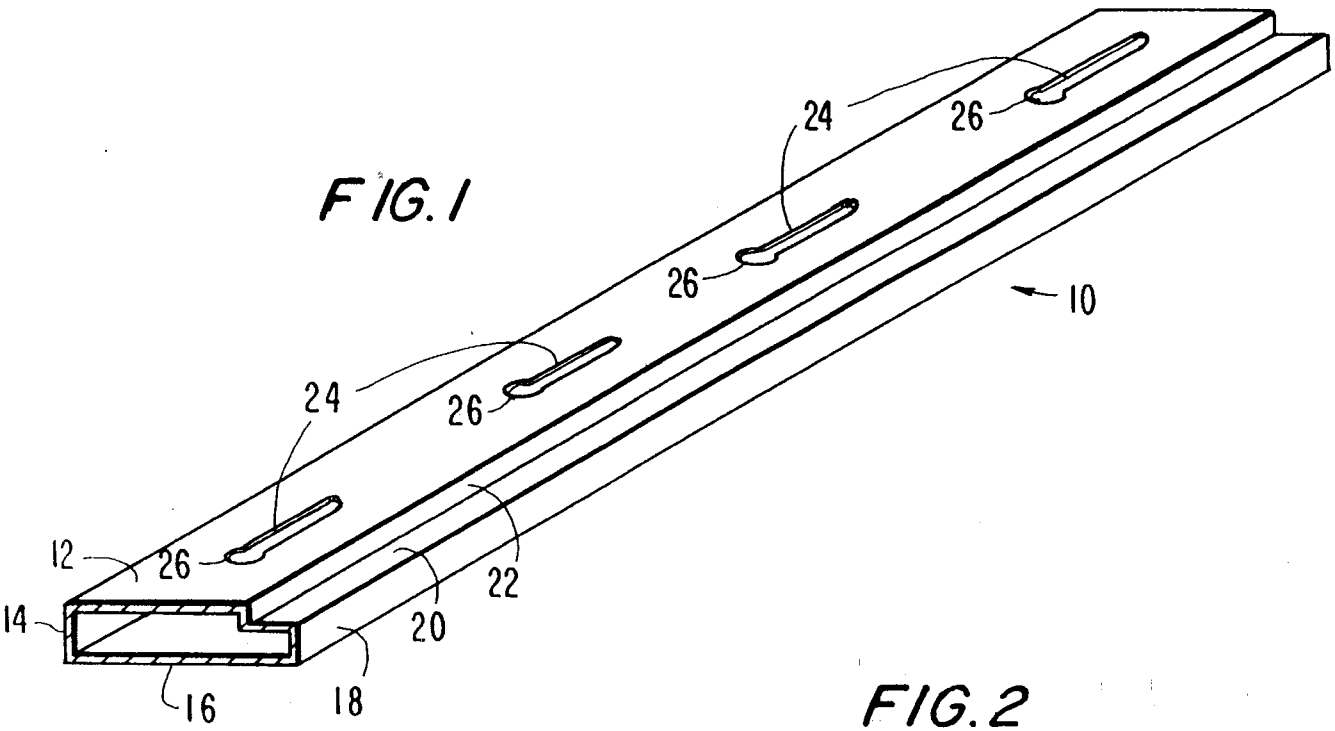
FIG. 1 is a perspective view of the deadman constructed according to the principles of the present invention.

In FIG. 1, the deadman 10 of the presently claimed invention is perspectively illustrated. The deadman 10 is preferably comprised of a single piece of substantially rigid material such a metal, plastic, and the like. In the most preferred embodiment, the material is of such rigidity that the deadman can be hollow and still maintain its functional rigidity. Materials which are conducive to hollow construction include aluminum, steel, polyvinylchloride, KEVLAR™, high impact plastic, wood, and the like. A hollow deadman substantially reduces material costs and weight.

The deadman 10 can be made from material which is extruded with the slots being formed after extrusion. The deadman 10 can also be formed in a mold, wherein the slots are formed in the molding process or added after the molding is complete.

One embodiment of the deadman 10, shown in FIG. 1, has a first side 12 having a first edge and a second edge, a second side 14 which is substantially perpendicular to the first side 12, the second side 14 having a first edge and a second edge wherein the first edge of the second side 14 is adjacent to the first edge of the first side 12, a third side 16 which is substantially perpendicular to the second side 14 and substantially parallel to and opposing the first side 12 having a first edge and a second edge wherein the first edge of the third side 16 is adjacent the second edge of the second side 14, a fourth side 18 which is substantially parallel and opposing the second side 14 having a first edge and a second edge wherein the first edge of fourth side 18 is adjacent the second edge of the third side 16, a fifth side 20 which is substantially parallel and opposing the third side 16 having a first edge and a second edge wherein the first edge of the fifth side 20 is adjacent the second edge of the fourth side 18, and a sixth side 22 which is substantially parallel and opposing the second side 14 having a first edge and a second edge wherein the first edge of the sixth side 22 is adjacent the second edge of the fifth side 20 and the second edge of the sixth side 22 is adjacent the second edge of the first side 12. This configuration results in a notch being formed by fifth side 20 and sixth side 22.

Preferably, the deadman 10 is of a sufficient length to span at least two stud members of a supporting structure.

Figure 2:
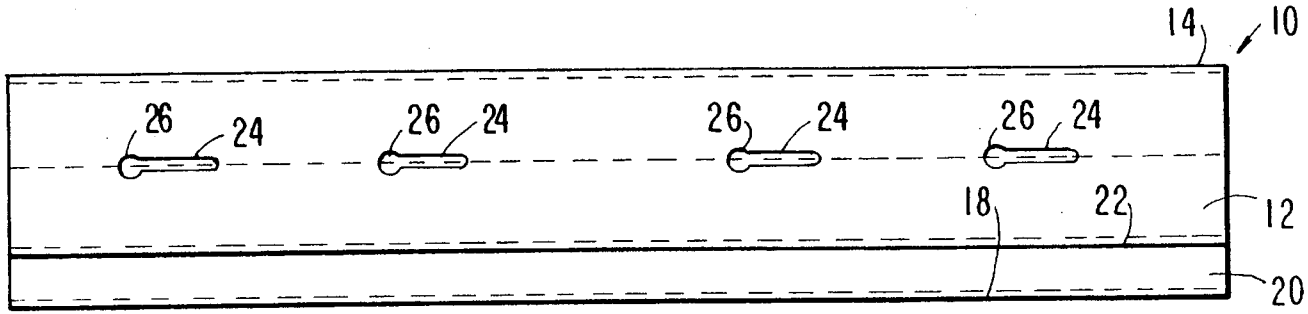
FIG. 2 is a top plan view of the deadman of FIG. 1.

The deadman 10 shown in FIGS. 1 and 2 is made from hollow, rigid material and has means for attaching the deadman 10 to a supporting structure. The means comprising a plurality slots 24 extending through the first side 12. The slots 24 are of a predetermined width to retain a head of a nail or screw of a predetermined size, and are of a sufficient length to allow lateral adjustment of the deadman 10. The slots 24 are preferably parallel to the length of the deadman 10 and each slot 24 has the same axis as the others. It is understood that if the deadman is made of a solid material, the slots 24 must be chamfered in such a manner to retain the head of the nail or screw. The spacing between the slots 24 is gauged to industry standards for spacing between stud members of the supporting structure. Preferably, the slots 24 are offset or arranged to accommodate a variety of standard spacings between stud members of the supporting structure. Additionally, each slot 24 has an open area 26 which is larger than the head of the nail or screw. Preferably, each open area 26 is located proximate to the midpoint of the length of each slot 24.

Figure 3:
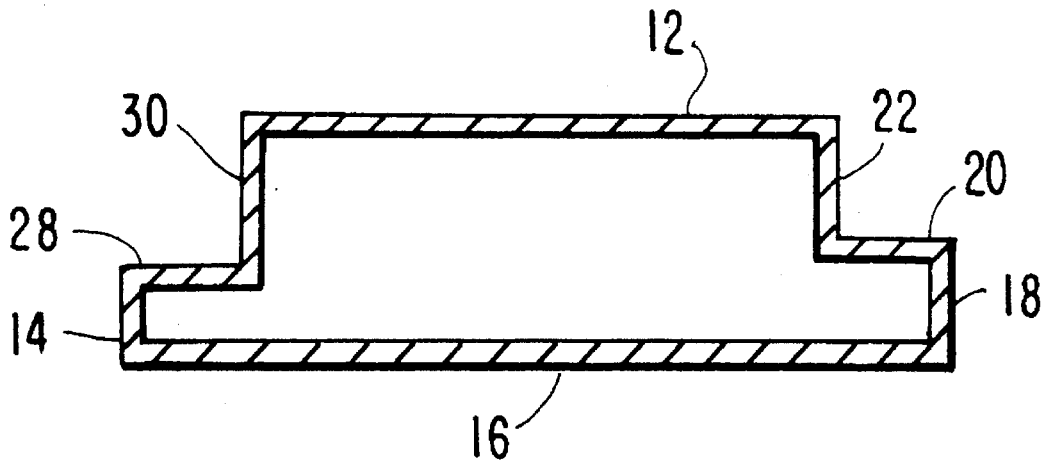
FIG. 3 is a cross-sectional view of the deadman of a two notch embodiment.
Figure 4:
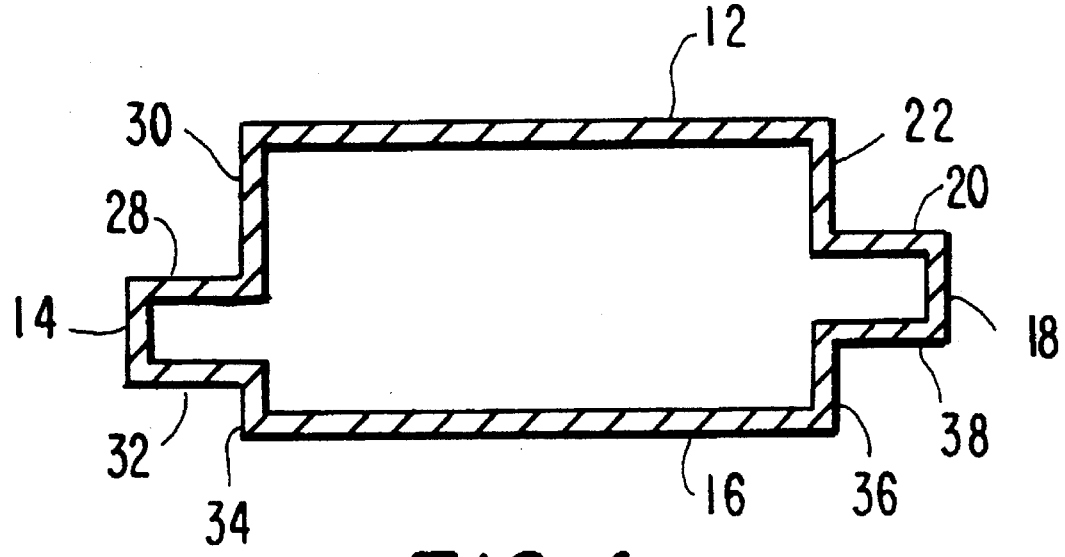
FIG. 4 is a cross-sectional view of the deadman of a four notch embodiment.

It is of course understood that the deadman 10 can be designed with addition sides so as to form a plurality of notches on the deadman 10 such that the dimensions of the notches vary to accommodate various panel thicknesses. FIGS. 3 and 4 show the deadman 10 in cross-section to show the multi-notch embodiments. FIG. 3 shows an two notch embodiment wherein additional sides 28 and 30 to form a second notch opposing the first notch from by the fifth side 20 and the sixth side 22. FIG. 4 shows a four notch embodiment wherein sides 20 and 22, 28 and 30, 32 and 34, and 36 and 38 form notches in each cross-sectional corner of the deadman 10. Of course, to utilize a four notch design additional slots 24 and corresponding open areas 26 will have to be provided in the third side 16.

The deadman 10 is employed by setting a plurality of screws or nails in the supporting structure at a predetermined location in a straight line which is perpendicular to the studs in the supporting structure. Each screw or nail is set such that a determined length of each screw or nail extends from the stud. For example, the deadman 10 shown in FIGS. 1 and 2 can be placed on the supporting structure such that the first side 12 is flush with the studs and the open areas 26 receive the heads of the screws or nails (see FIG. 5). The deadman is then moved laterally to secure the heads of the screws or nails in the slots 24. This arrangement places the notch toward the supporting structure such that the sixth side 22 is substantially perpendicular and the fifth side 20 is substantially parallel to the supporting structure (see FIG. 5).

Figure 5:
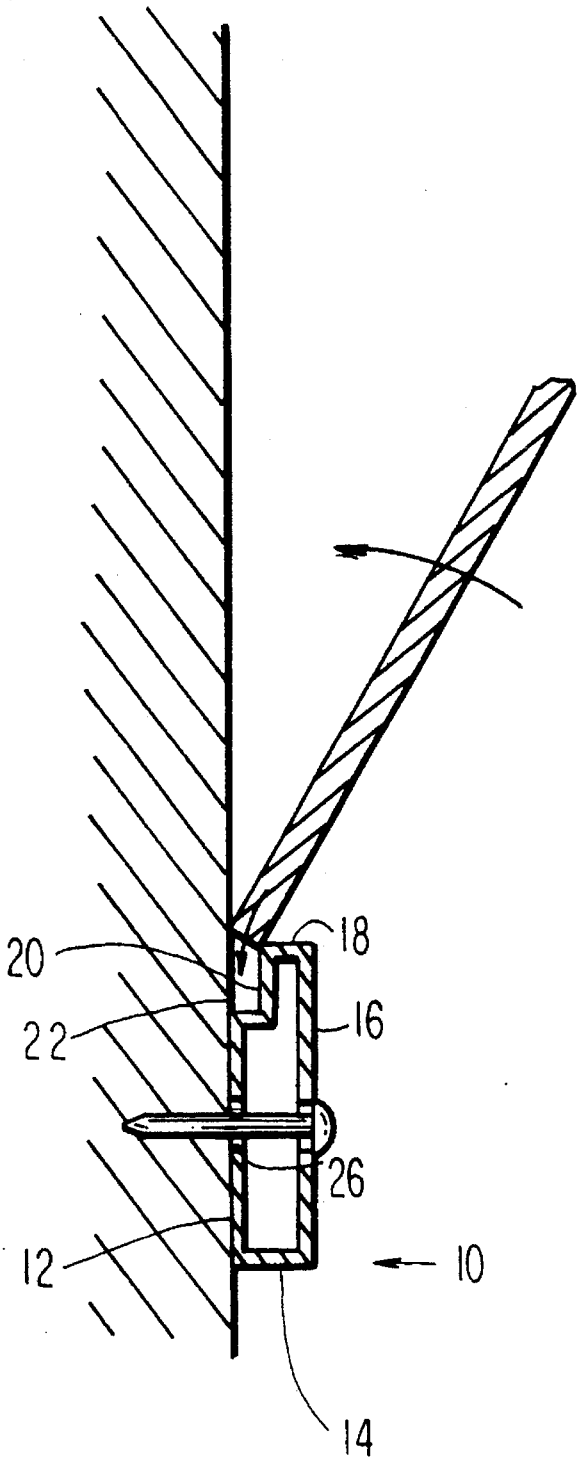
FIG. 5 is a cross-sectional view of the deadman attached to supporting structure, with a panel being inserted in the notch and against the supporting structure.
Figure 6:
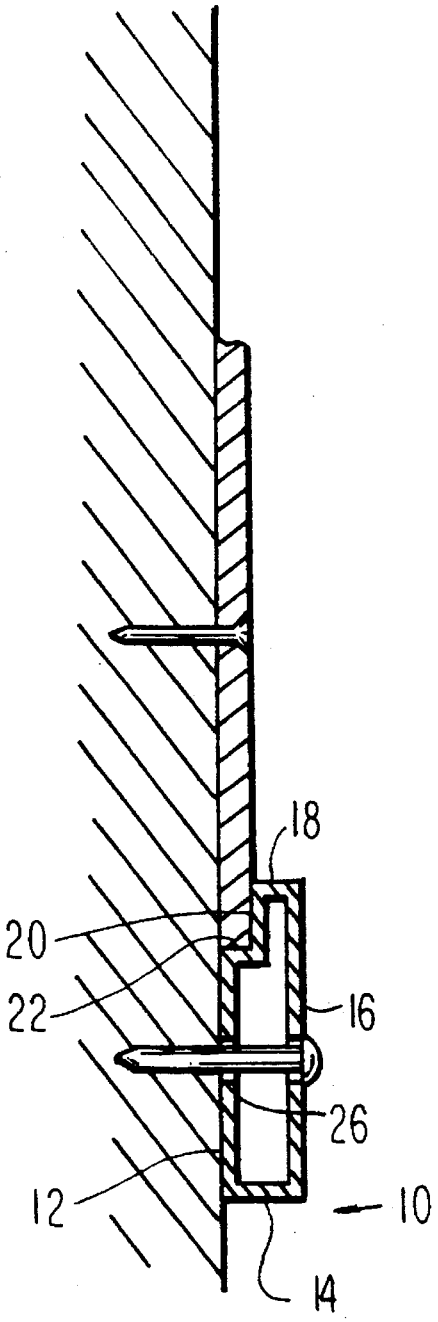
FIG. 6 is a cross-sectional view of the deadman and panel secured to the supporting structure.

Having secured the deadman 10 to the supporting structure, a worker inserts one edge of the panel in the notch which will hold the panel edge in place while the worker fastens the opposing panel edge to the supporting structure (see FIGS. 5, 6). The worker then moves toward the deadman 10 securing the panel to the supporting structure (see FIG. 6). Once the panel is fastened, the deadman 10 is shifted laterally to align the open areas 26 with the screw or nail heads and the deadman 10 is then removed. Once the deadman 10 is removed the screws or nails are removed or preferably set into the stud members such that the heads are flush with the stud member surface. Thus, when using the deadman 10, a worker can single-handedly fasten panels to the supporting structure.

Having thus described in detail preferred embodiments of the present invention, it is to be understood that the invention defined by the appended claims is not to be limited by particular details set forth in the above description as many apparent variations thereof are possible without departing from the spirit or scope thereof.

What is claimed is:

1. An apparatus for temporarily holding panel material in position while the material is being fastened to a supporting structure, comprising:

a main body having a first pair of elongated, opposing, generally rectangular sides and a second pair of elongated, opposing, generally rectangular sides perpendicular and adjacent the first side pair;

at least one pair of elongated, perpendicular, generally rectangular sides adjacent one of said first side pair and adjacent one of said second side pair defining a notch along the length of said main body; and means for securing the main body to the supporting structure;

wherein the means for securing the main body to the supporting structure comprises the main body having portions defining a plurality of slots in at least one side of the main body wherein each slot has a predetermined width to retain a head of a nail or a screw.

2. The apparatus of claim 1, wherein the main body is of sufficient length to span at least two stud members of the supporting structure.

3. The apparatus of claim 1, wherein each of the slots is parallel to the length of the main body and each slot is of sufficient length to allow lateral adjustment of the main body.

4. An apparatus for temporarily holding panel material in position while the material is being fastened to a supporting structure, comprising:

an elongated main body having sufficient length to span at least two stud members of the supporting structure, comprising:

a first side having a first edge and a second edge, a second side which is substantially perpendicular to the first side, said second side having a first edge and a second edge wherein the first edge of the second side is adjacent to the first edge of the first side, a third side which is substantially perpendicular to the second side and substantially parallel to and opposing the first side having a first edge and a second edge wherein the first edge of the third side is adjacent the second edge of the second side, a fourth side which is substantially parallel and opposing the second side having a first edge and a second edge wherein the first edge of the fourth side is adjacent the second edge of the third side, a fifth side which is substantially parallel and opposing the third side having a first edge and a second edge wherein the first edge of the fifth side is adjacent the second edge of the fourth side, and a sixth side which is substantially parallel and opposing the second side having a first edge and a second edge wherein the first edge of the sixth side is adjacent the second edge of the fifth side and the second edge of the sixth side is adjacent the second edge of the first side, wherein the fifth side and the sixth side define a notch; and means for securing the main body to the supporting structure comprising the main body having portions defining a plurality of slots in the first side of the main body wherein each slot has a predetermined width to retain a head of a nail or a screw, and wherein each slot is parallel to the length of the main body and of sufficient length to allow lateral adjustment of the main body.

* * * * *